US005634773A

United States Patent [19]

Tanino et al.

[11] Patent Number: 5,634,773

[45] Date of Patent: Jun. 3, 1997

[54] SUPERHIGH PRESSURE CONTROL SYSTEM

[75] Inventors: Yoshio Tanino; Takuichi Habiro; Takaaki Noda; Kouichi Hayashi, all of Osaka, Japan

[73] Assignee: Daikin Industries, Ltd., Osaka, Japan

[21] Appl. No.: 374,714

[22] PCT Filed: May 25, 1994

[86] PCT No.: PCT/JP94/00833

§ 371 Date: Jan. 26, 1995

§ 102(e) Date: Jan. 26, 1995

[87] PCT Pub. No.: WO94/27794

PCT Pub. Date: Dec. 8, 1994

[30] Foreign Application Priority Data

May 27, 1993 [JP] Japan ..... 5-126125
Jul. 14, 1993 [JP] Japan ..... 5-174174

[51] Int. Cl.[6] ..... F04B 49/00

[52] U.S. Cl. ..... 417/46; 60/420; 60/459

[58] Field of Search ..... 417/46; 60/459, 60/420, 452, 494; 91/418, 461

[56] References Cited

U.S. PATENT DOCUMENTS 3,893,790 7/1975 Mayer .
4,624,107 11/1986 Horiuchi et al. ..... 60/547.1
4,697,498 10/1987 Yoshikawa et al. ..... 91/420
5,351,790 10/1994 Machida ..... 188/314

FOREIGN PATENT DOCUMENTS 50-27189 3/1975 Japan .
63-39799 2/1988 Japan .

*Primary Examiner*—Timothy Thorpe
*Assistant Examiner*—Xuan M. Thai
*Attorney, Agent, or Firm*—Birch, Stewart, Kolasch & Birch, LLP

[57] ABSTRACT

First and second boosters 1, 2 which, through reciprocating motions of oil hydraulic cylinders *6a*, *6b*, pressurize water sucked into plunger chambers *3a*, *3b* to a superhigh pressure level are connected in parallel to a water discharge line 8, First and second three-position directional control valves 9, 10 are arranged between the oil hydraulic cylinder of each booster and a hydraulic pump 11, 12 so as to cause the hydraulic cylinder to perform a reciprocal movement. The first and second boosters 1, 2 are provided respectively with first and second sets of forward stroke and return stroke sensors (29, 29'; 30, 30') for detecting positions adjacent to respective ends of pressing and suction strokes. During a pressurizing operation of the first booster 1, a control unit 31 causes the second directional control valve 10 to be switched from a suction position to a prepressing position according to a detection signal from the second return stroke sensor 30', and then causes the first three-position directional control valve 9 to be switched from a pressing position to a suction position, and the second three-position directional control valve 10 to be switched from a prepressing position to a pressing position according to a detection signal from the first forward sensor 29. A similar switching control is performed during a pressurizing operation of the second booster 2. A superhigh pressure control system which is compact and inexpensive is thus provided.

6 Claims, 4 Drawing Sheets

SUPERHIGH PRESSURE CONTROL SYSTEM

TECHNICAL FIELD

The present invention relates to a superhigh pressure control system for controlling a booster for boosting water sucked into a plunger chamber through a reciprocating motion of a hydraulic cylinder to superhigh pressure, and water-jet type cutting apparatus incorporating the system.

BACKGROUND ART

FIG. 4 shows a circuit diagram for a conventional superhigh pressure control system applicable to water-jet type cutting apparatus (Japanese Patent Application Laid-Open No. 63-39799). The superhigh pressure control system comprises a booster 41 including a double acting hydraulic cylinder 42 having a piston P and plungers $P_1$, $P_2$ arranged at opposite sides thereof and fitted respectively in water-pressurizing plunger chambers $C_3$, $C_4$, and ports at ends of the plunger chambers $C_3$, $C_4$ which are connected in parallel to a water supply line 46 of a water supply pump 45 via suction check valves 43, 44, the ports being also connected in parallel via discharge check valves 47, 48 to a superhigh pressure water discharge line 49 equipped sequentially with an accumulator 50, a nozzle on-off valve 51, and a jet nozzle 52. A two-position directional control valve 54 for switching the reciprocating motion of the piston is provided between the respective ports at opposite ends of a cylinder chamber of the hydraulic cylinder 42 and a hydraulic pump 53. Air nozzles 57, 58 are fixed adjacent the jet nozzle 52 and in slightly spaced apart relation in the directions of movement (designated by arrows X, Y) of a moving carriage 55 on which is carried a material to be cut 56, the air nozzles being connected to an air pressure source 61 via on-off valves 59, 60. Relief valves 65, 66 are respectively disposed between the water supply line.46 and a water tank 62 and between a main line 63 for the hydraulic pump 53 and an oil tank 64.

When the hydraulic pump 53 is actuated with the two-position directional control valve 54 set to assume a symbol position $V_1$, hydraulic oil is supplied to a cylinder chamber $C_1$ and the hydraulic oil in a cylinder chamber $C_2$ is discharged into the oil tank 64, so that the piston P shifts to the right side and the water in the plunger chamber $C_4$ is pressurized by the plunger $P_2$ to be boosted in proportion to the ratio of sectional area of the piston P to the plunger $P_2$. The water which is boosted by the booster 41 to superhigh pressure is ejected from the jet nozzle 52 to the material 56 to be cut after passing through the check valve 48, accumulator 50, and the nozzle on-off valve 51 at symbol position $V_{11}$. Whilst, water from the water supply pump 45 is sucked via the check valve 43 into the plunger chamber $C_3$, as the pressure therein turns negative as a result of the shifting of the piston P to the right.

Subsequently, when the two-position directional control valve 54 is switched to symbol position $V_2$, the hydraulic oil from the hydraulic pump 53 is supplied to the cylinder chamber $C_2$ and the piston P is shifted to the left, so that the water in the plunger chamber $C_3$ is pressurized by the plunger $P_1$. Thus, the boosted water or superhigh pressure water is similarly ejected to the material 56 to be cut via the check valve 47 and other associated members. Whilst, water from the water supply pump 45 is sucked into the plunger chamber $C_4$ which is now under negative pressure.

When superhigh pressure water is ejected from the jet nozzle 52 in this way to cut the material 56 to be cut on the moving carriage 55 while moving the carriage in the direction of arrow X, the on-off valve 59 is opened by exciting a solenoid $S_1$, and air supplied from a pneumatic source 61 is ejected from an air nozzle 57 to blow away naps, dust and water deposits present on a cut surface just after cutting. For the purpose of cutting while moving the moving carriage 55 in the direction of arrow Y, the on-off valve 60 at the opposite side is opened by exciting a solenoid $S_2$ and air is ejected from a pneumatic nozzle 58 to blow away dust and the like for quality improvement with respect to cut surfaces.

FIG. 5 is a graph showing time changes in the strokes of the prior art double-acting hydraulic cylinder 42, wherein a solid line represents strokes of one plunger $P_1$, while a broken line represents strokes of the other plunger $P_2$. As may be understood from FIGS. 4 and 5, when the other plunger $P_2$is in a rightward ascending press stroke, the one plunger $P_1$ is in a rightward descending suction stroke, and simultaneously upon the other plunger $P_2$ having reached the end of the press stroke for being switched to a rightward descending suction stroke, the one plunger $P_1$ reaches the end of the suction stroke and is switched to a rightward climbing press stroke. Therefore, at the time of stroke changing, the water pressure in one plunger chamber $C_3$ is still low which has just come into a press stroke at the end of superhigh pressure water discharge from the other plunger chamber $C_4$ into the water discharge line 49 which had reached the end of a pressing stroke thereof, so that if the condition remains as such, there will occur an abrupt decrease in the water pressure of the water discharge line 49 which will result in considerable fluctuations in the water pressure of the water discharge line 49.

Thus, in order to alleviate such fluctuations in the discharge water pressure, a superhigh-pressure type accumulator 50 is disposed on the water discharge line 49 at the downstream of the discharge check valves 47, 48, whereby the pulsation of the superhigh pressure water is attenuated to permit smooth supply to the jet nozzle 52.

However, this poses a problem that the accumulator 50 is very expensive to produce because it is for superhigh pressure service and, in addition, is required to have a considerable volume if pulsation is to be eliminated to an extent sufficient to improve the performance of the booster 41 and the service life of various components used in the oil hydraulic and water hydraulic circuits, which results in considerable increase in the size of the booster and in the cost of booster production.

DISCLOSURE OF THE INVENTION

Accordingly, it is an object of the present invention to provide a superhigh pressure control system which includes two boosters connected in parallel to each other and two directional control valves for controlling them by phase difference, and which can sufficiently reduce variations in discharge-water pressure, can enhance the performance and service life of oil hydraulic and water hydraulic components, such as boosters, and can provide for reduction in production cost and in booster size.

In order to accomplish the above object, according to the present invention, there is provided a superhigh pressure control system comprising: a first booster and a second booster which are operative through reciprocating motions of oil hydraulic cylinders to pressurize water sucked into water-pressurizing plunger chambers and discharge pressurized water to a water discharge line; first directional control means and second directional control means which are respectively disposed between respective oil hydraulic cylinders of the first and second boosters and oil hydraulic sources so as to enable reciprocation of the oil hydraulic cylinders, the first and second directional control means having three switching positions, which are pressing, prepressing and suction positions; a first forward stroke sensor for detecting a position adjacent to the end of each pressing stroke and a first return stroke sensor for detecting a position adjacent to the end of each suction stroke which are disposed in the first booster; a second forward stroke sensor for detecting a position adjacent to the end of each pressing stroke and a second return stroke sensor for detecting a position adjacent to the end of each suction stroke which are disposed in the second booster; and control means which is operative, during each pressing stroke of the first booster, to switch the second directional control means from the suction position to the prepressing position in response to a detection signal from the second return stroke sensor, and then to switch the first directional control means from the pressing position to the suction position and the second directional control means from the prepressing position to the pressing position in response to a detection signal from the first forward stroke sensor, and which is operative, during each pressing stroke of the second booster, to switch the first directional control means from the suction position to the IS prepressing position in response to a detection signal from the first return stroke sensor, and then to switch the second directional control means from the pressing position to the suction position and the first directional control means from the prepressing position to the pressing position in response to a detection signal from the second forward stroke sensor.

Assume that, in the above described arrangement, the first directional control means, disposed between the hydraulic source and the first booster, has been switched to the switching position for a pressing (forward) stroke, while the second directional control means, disposed between the hydraulic source and the second booster, has been switched to the switching position for a suction (return) stroke. Then, water pressurized to a high pressure level is discharged into the water discharge line from the plunger chamber of the first booster which is in the process of a pressing stroke under oil supply from the hydraulic source, while water is sucked into the plunger chamber of the second booster which is in the process of a suction stroke under oil supply from the hydraulic source.

As operation of the second booster progresses up to a position adjacent to the end of suction stroke, the second return stroke sensor, when it detects the approach, generates a detection signal, and the control means, upon receipt of the detection signal, causes the second directional control means to be switched over to the switching position for prepressing. Accordingly, when the first booster reaches the first forward stroke sensor at a location close to the end of a pressing stroke and nearly completes the discharge of high pressure water, the second booster which is in progress of its prepressing stroke is ready to discharge high pressure water from its plunger chamber. The control means, upon receipt of a detection signal from the first forward stroke sensor, causes the first directional control means to be switched from the switching position for pressing to that for suction, and causes the second directional control means to be switched from the switching position for prepressing to that for pressing. Accordingly, the first booster is switched from a pressing stroke to a suction stroke, and the second booster is switched from a prepressing stroke to a pressing stroke. Thus, pressure variations of superhigh pressure water discharged into the water discharge line is considerably reduced without the provision of an accumulator.

The second booster which is in the course of a pressing stroke discharges high pressure water from its plunger chamber into the water discharge line, while the first booster which is in the course of a suction stroke sucks water into its plunger chamber. As the first booster approaches up to a site close to the end of a suction stroke, the first return stroke sensor, having detected the same, generates a detection signal, and the control means, upon receipt of the detection signal, causes the first directional control means to be switched over to the switching position for prepressing. Accordingly, when the second booster reaches the second forward stroke sensor at a location close to the end of a pressing stroke and nearly completes the discharge of high pressure water, the first booster which is in progress of its prepressing stroke is ready to discharge high pressure water from its plunger chamber. The control means, upon receipt of a detection signal from the second forward stroke sensor, causes the second directional control means to be switched from the switching position for pressing to that for suction, and causes the first directional control means to be switched from the switching position for prepressing to that for pressing. Accordingly, the second booster is switched from a pressing stroke to a suction stroke, and the first booster is switched from a prepressing stroke to a pressing stroke. Thus, pressure variations of superhigh pressure water discharged into the water discharge line is likewise considerably reduced.

Preferably, a first restriction and a second restriction are provided respectively in oil-supply side passages at switching positions for prepressing for the first directional control means and second directional control means.

Where such arrangement is made, before the first booster reaches the end of a pressing stroke, the water pressure in the plunger chamber of the second booster is adjusted by the second restriction to a predetermined discharge pressure so as to be ready for necessary discharge, and similarly before the second booster reaches the end of a pressing stroke, the water pressure in the plunger chamber of the first booster is adjusted by the first restriction to a predetermined discharge pressure so as to be ready for necessary discharge.

It is preferable to arrange that hydraulic oil discharged during the pressing stroke of each of the hydraulic cylinders of the first and second boosters is discharged into a tank via a common return line, the return line being provided with a check valve for setting back pressure.

Then, the hydraulic oil discharged in the course of pressing strokes of the hydraulic cylinders of the first and second boosters flows into the tank via the common return line which is provided with a back pressure setting check valve. Therefore, when the first booster is in the course of a pressing stroke, the hydraulic oil discharged from the hydraulic cylinder of the first booster is restrained by the check valve from flowing into the tank and thus flows into the hydraulic cylinder of the second booster so that suction strokes (return strokes) of the hydraulic cylinder are accelerated, while when the second booster is in the course of a pressing stroke, the hydraulic oil discharged from the hydraulic cylinder of the second booster likewise accelerates suction strokes (return strokes) of the hydraulic cylinder of the first booster.

Preferably, the hydraulic sources consist of a first oil hydraulic pump provided for the first booster and a second oil hydraulic pump provided for the second booster.

By so arranging, it is possible to reduce possible variations in the load on the hydraulic pump as compared with the case that oil supply is made by a single common hydraulic pump, because oil supply to the respective boosters is performed by separate and independent hydraulic pumps.

Accordingly, it is possible to further reduce pressure variation of superhigh pressure water discharged into the water discharge line.

The water-jet type cutting apparatus preferably comprises the above described superhigh pressure control system, and a jet nozzle disposed at an end of the water discharge line, and an on-off valve disposed between the jet nozzle and the superhigh pressure control system.

In the water-jet type cutting apparatus of the above arrangement, a jet of superhigh pressure water with less pressure variation discharged from the superhigh pressure control system is ejected toward a material to be cut from the jet nozzle at the end of the water discharge line via the on-off valve on the line. Through this arrangement, an accumulator of superhigh pressure service is no longer required, which results in production cost reduction as well as size reduction of the apparatus. A stable jet of superhigh pressure water can be obtained which can enhance the performance and service life of oil hydraulic and water hydraulic components, such as boosters. Thus, satisfactory cutting operation can be achieved.

When starting the motor for actuating the hydraulic pumps, it may be noted that where the discharge line for the hydraulic pumps is connected to the high pressure side of the hydraulic cylinders through the first and second directional control means, an excessive load may be involved because the loads of the hydraulic pumps and the inertia of the motor are considerably large.

Preferably, therefore, the superhigh pressure control system comprises a first booster and a second booster which are operative through reciprocating motions of oil hydraulic cylinders to pressurize water sucked into water-pressurizing plunger chambers and discharge pressurized water to a water discharge line; first directional control means and second directional control means which are respectively disposed between respective oil hydraulic cylinders of the first and second boosters and oil hydraulic pumps actuated by a motor so as to enable reciprocations of the oil hydraulic cylinders, the first and second directional control means having three switching positions, which are pressing, prepressing and suction positions; and control means for positioning both the first and second directional control means at switching positions for suction for a predetermined time when the motor is actuated.

In the superhigh pressure control system of the above arrangement, during the process of motor starting, the control unit causes the first and second directional control means to be positioned at the switching positions for suction for a predetermined time. Then, the hydraulic oil discharged from the hydraulic pumps causes the hydraulic cylinders to move return way so as to allow water to be sucked into the water pressing plunger chambers. Therefore, the load of the hydraulic pumps is far much smaller than that in the case where water is pressurized, and this enables the motor to readily start without involving any motor stall.

After the lapse of the predetermined time, the motor goes into steady run at a predetermined speed. Then, it is possible to carry out phase difference control with the first and second boosters by alternately switching the first and second directional control means to respective positions of pressing, prepressing and suction, without involving motor stop.

BEST MODE FOR CARRYING OUT THE INVENTION

The invention will now be described in detail with reference to an illustrated embodiment.

Figure 1:
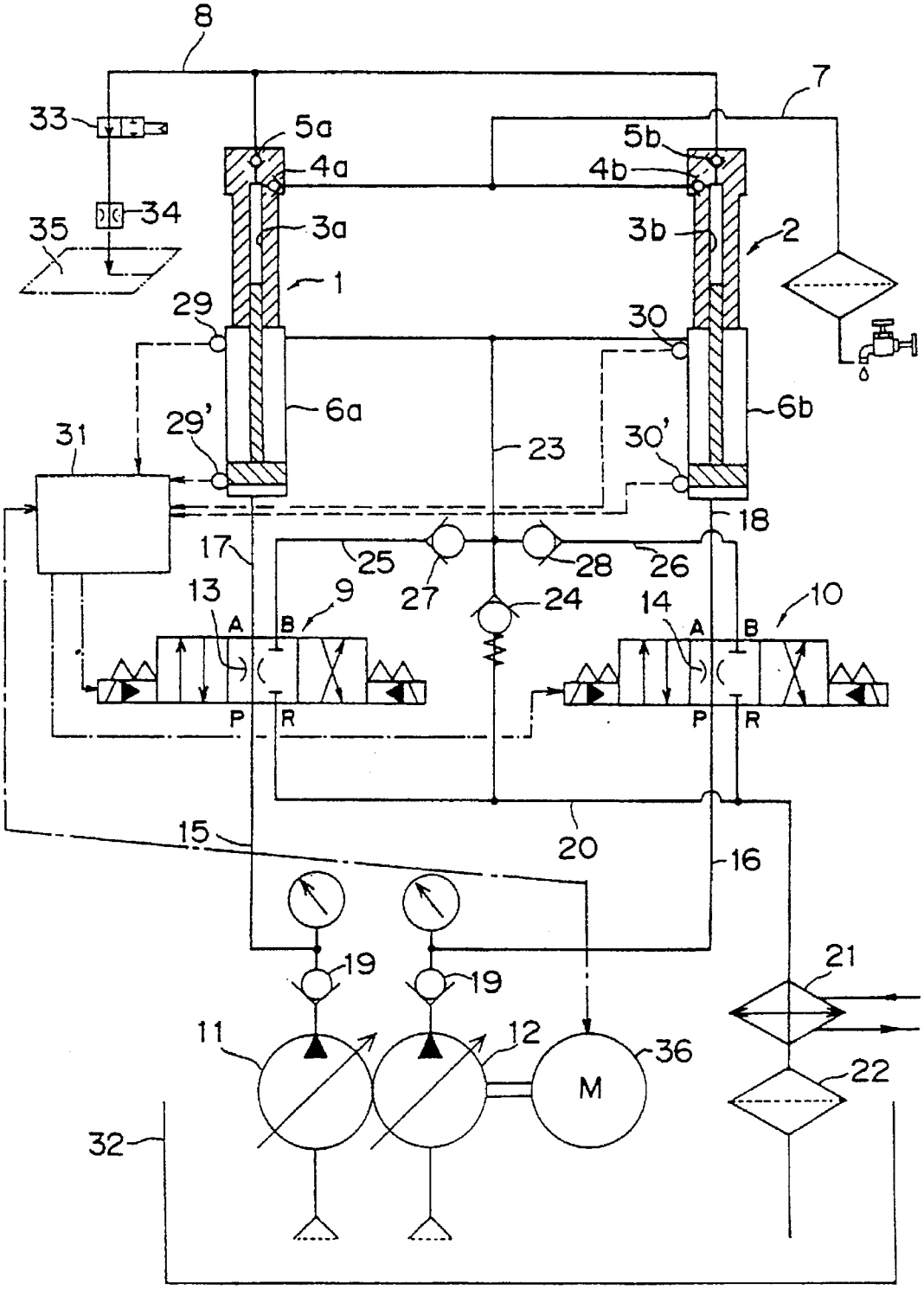
FIG. 1 is a circuit diagram showing one embodiment of water-jet type cutting apparatus incorporating a superhigh pressure control system in accordance with the present invention.

FIG. 1 is a circuit diagram showing a water-jet type cutting apparatus incorporating a superhigh pressure control system of the present invention. The superhigh pressure control system has a first booster 1 and a second booster 2 connected in parallel with each other to a superhigh pressure water discharge line 8 via discharge check valves 5*a* and 5*b*, respectively. The boosters 1, 2 are operative through reciprocating motions of oil hydraulic cylinders 6*a*, 6*b*, respectively, to pressurize to superhigh pressure the water sucked from a water supply line 7 into water pressurizing plunger chambers 3*a*, 3*b* via suction check valves 4*a*, 4*b*, respectively, and to discharge the pressurized water to the water discharge line 8.

Between the first booster 1 and a first hydraulic pump 11 of the variable volume type which supplies hydraulic oil thereto, and between the second booster 2 and a second hydraulic pump 12 of the variable volume type which supplies hydraulic oil thereto there are respectively disposed three-position directional control valves 9 and 10, as first and second directional control means, which have switching positions of pressing, prepressing, and suction, so as to cause the respective oil hydraulic cylinders 6*a*, 6*b* to move in reciprocation. The two hydraulic pumps 11, 12 and a tank 32 constitute a hydraulic source.

The first and second hydraulic pumps 11, 12 are driven by a common motor 36.

The three-position directional control valve 9 has ports P, R, A, B such that P and R are respectively connected with A and B at the left side position, i. e., pressurizing position in the illustrated circuit, and with B and A at the right side position, i.e., suction position, while at the center valve position, i. e., prepressurizing position, P and A are interconnected through a passage having a first restriction 13 and R and B are shut off from each other. The three-position directional control valve 10 is of the same construction as the three-position directional control valve 9 except that P and A are interconnected through a passage having a second restriction 14 at the center valve position. The port P of the three-position directional control valves 9, 10 each is connected to the corresponding hydraulic pump via one of discharge lines 15, 16 having a check valve 19; the port A is connected to a head chamber side port of the corresponding one of the hydraulic cylinders 6*a*, 6*b* via one of lines 17, 18; and the port R is connected to a common return line 20 provided with a cooler 21 and a filter 22. A plunger chamber side port of each of the oil hydraulic cylinders 6*a*, 6*b* is connected to the return line 20 by a common line 23 which is provided with a check valve 24 for back pressure setting so as to permit forward flow toward the return line 20. Further, a portion of the common line 23 which is located past the check valve 24 and nearer to each oil hydraulic cylinder is connected to port B of each of the three-position directional control valves 9, 10 through line 25, 26 provided with check valves 27, 28 for checking any oil flow toward the three-position directional control valves 9, 10.

Figure 3:
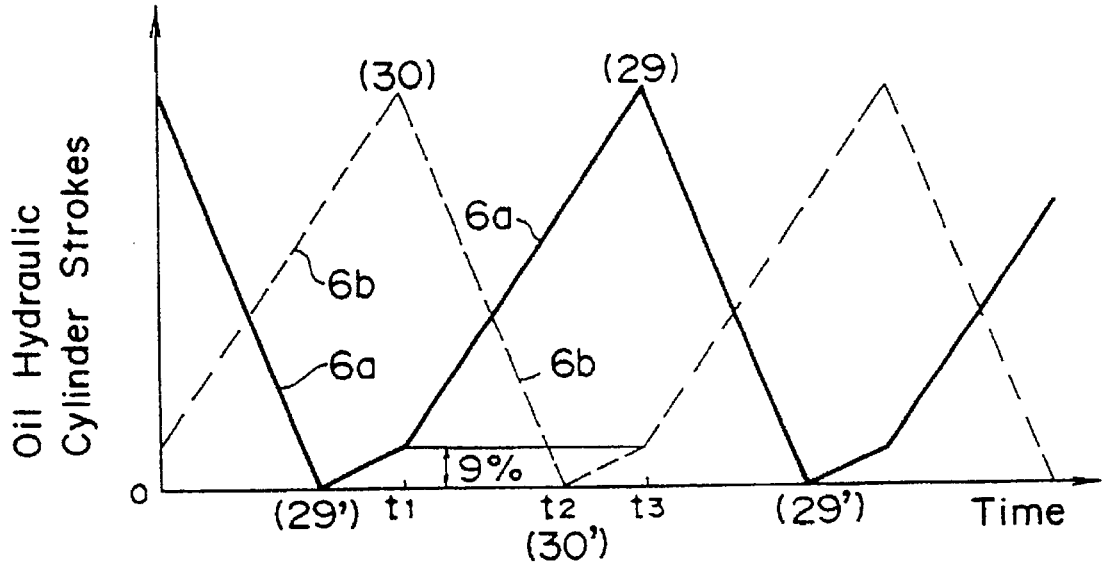
FIG. 3 is a diagram showing time changes in the strokes of hydraulic cylinders of first and second boosters in FIGS. 2A, 2B and 2C.
Figure 5:
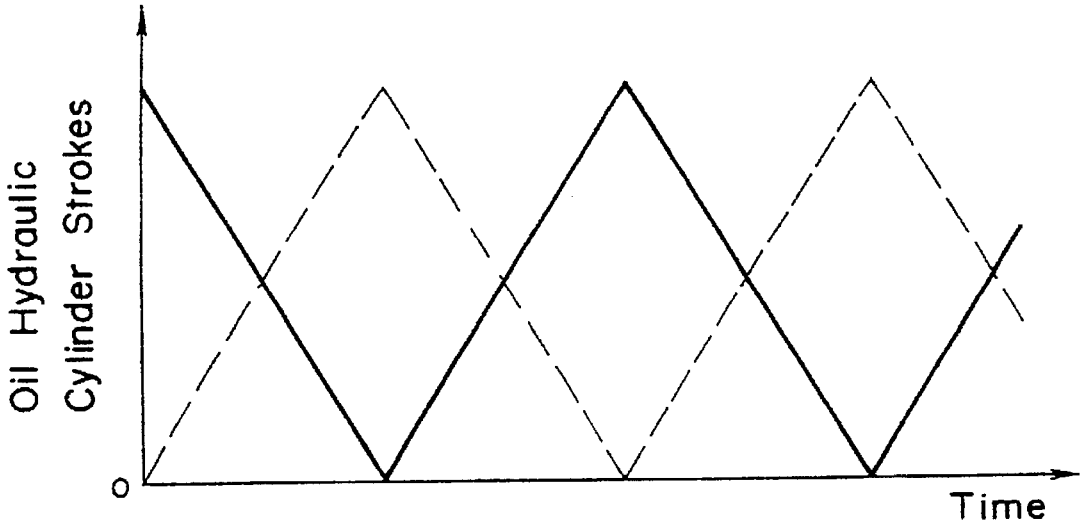
Fig. 5 Prior Art
FIG. 5 is a diagram showing time changes in the strokes of hydraulic cylinders of the conventional superhigh pressure control system.

The first oil hydraulic cylinder 6*a* is provided with a first forward stroke sensor 29 such as a proximity switch for detecting that the piston in the course of its forward stroke or pressing stroke has reached a point close to the end of the pressing stroke, and a first return stroke sensor 29' such as a proximity switch for detecting that the piston in the course of its return stroke or suction stroke has reached a point close to the end of the suction stroke. Similarly, the second oil hydraulic cylinder 6*b* is provided with a second forward stroke sensor 30 and a second return stroke sensor 30'. The relationship between these sensors with respect to their mounting positions may be explained as follows by FIG. 3 wherein time changes in strokes of respective oil hydraulic cylinders 6*a*, 6*b* are illustrated, with suction strokes (return strokes) plotted on the axis of ordinate with their ends taken as zero and time plotted on the axis of abscissa. When the first oil hydraulic cylinder 6*a* as represented by a solid line in FIG. 3 which is downwardly inclined to the right reaches the first return stroke sensor 29', the first directional control valve 9 is switched from the right side position to the center valve position for supplying hydraulic oil to the first oil hydraulic cylinder 6*a*. Then, a pressing stroke of the first hydraulic cylinder 6*a* progresses as much as 9% of one full stroke in the case of pressing up to the compressed volume of water, for example, 3000 kgf/cm$^2$, as shown by a solid line in FIG. 3 which is upwardly inclined to the right before the second oil hydraulic cylinder 6*b* as represented by a broken line in FIG. 3 which is upwardly inclined to the right reaches the second forward stroke sensor 30 at the end of its pressing stroke, so that the water pressure in the plunger chamber 3*a* of the first booster 1 has already reached a predetermined superhigh discharge pressure level. Conversely, assume that the second hydraulic cylinder 6*b* reaches the second return stroke sensor 30', its stroke being then switched to a pressing stroke. As is apparent from FIG. 3, in this case, too, it may be said that the same will apply for the time period of up to its reaching the second forward stroke sensor 30.

Further, as FIG. 1 shows, the superhigh pressure control system of the invention includes a control unit 31 as a control means which, when and after actuating the motor 36 for the first and second hydraulic pumps 11, 12, switchingly controls the three-position directional control. Valves 9, 10 in response to detection signals from the sensors 29, 29', 30, 30'.

When actuating the motor 36, the control unit 31 causes the first and second three-position directional control valves 9, 10 to take a switching position for suction (right side position) for a predetermined time (e.g., 7 seconds), and then causes the first three-position directional control valve 9 to take a switching position for prepressing (center valve position) and the second three-position directional control valve 10 to take a switching position for pressing (left side position) for a predetermined time (e.g., 1.5 seconds).

After the motor is actuated, the control unit 31 is operative in such a way that when the first three-position directional control valve 9 is at the left side position as shown and when the first booster 1 is in the course of a pressing stroke, the control unit 31 causes the second three-position directional control valve 10 to be switched from the right side position to the center valve position in response to a detection signal from the second return stroke sensor 30', and then causes the first three-position directional control valve 9 to be switched from the left side position to the right side position, and the second three-position directional control valve 10 to be switched from the center valve position to the left side position, in response to a detection signal from the first forward stroke sensor 29. When the second three-position directional control valve 10 is at the left side position as shown and when the second booster 2 is in the course of a pressing stroke, the control unit 31 causes the first three-position directional control valve 9 to be switched from the right side position to the center valve position in response to a detection signal from the first return stroke sensor 29', and then causes the second three-position directional control valve 10 to be switched from the left side position to the right side position, and the first three-position directional control valve 9 to be switched from the center valve position to the left side position, in response to a detection signal from the second forward stroke sensor 30.

More particularly, after the motor is actuated, the three-position directional control valves 9, 10 are controlled by the control unit 31 as follows. At time $t_1$ in FIG. 3, the first three-position directional control valve 9 which has been at the center valve position in FIG. 1 is caused to be switched over to the left side position in response to a detection signal from the second forward stroke sensor 30, and where the discharge pressure is at, for example, 3000 kgf/cm$^2$, the first booster 1 which has travelled up to 9% of one full pressing stroke at low speed goes into a high-speed pressing stroke (see the rightward ascending solid line in FIG. 3), while the second three-position directional control valve 10 which has been at the left side position in FIG. 1 is caused to be switched over to the right side position in response to a detection signal from the second forward stroke sensor 30 so that the second booster 2 goes into a suction stroke from the pressing stroke (a shift from the FIG. 2A state to the FIG. 2B state) (see the rightward descending broken line in FIG. 3). Next, at time $t_2$ in FIG. 3, when the second return stroke sensor 30' detects the approach of the piston, the second three-position directional control valve 10 is switched to the center valve position in FIG. 1, whereupon the second booster 2 which has reached the end of suction stroke goes into a low-speed pressing stroke under oil supply via the second restriction 14 (a shift from the FIG. 2B state to the FIG. 2C state). Then, at time $t_3$ in FIG. 3, when the first booster 1 reaches the end of pressing stroke so that the first three-position directional control valve 9 is switched to the FIG. 1 right side position in response to a detection signal from the first forward stroke sensor 29, the second booster 2 which has travelled up to 9% of one full stroke at low speed goes into a pressing stroke of high speed as a result of the second three-position directional control valve 10 being switched over to the left side position in response to a detection signal from the first forward stroke sensor 29 (a shift from the FIG. 2C state to the FIG. 2A state). It may be noted in the above conjunction that the first and second boosters 1, 2 are of such arrangement that when they have travelled up to 9% of one full pressing stroke at low speed through the first and second restrictions 13, 14 of the three-position directional control valves 9, 10, the water pressure within each of the plunger chambers 3*a*, 3*b* reaches the predetermined discharge pressure of superhigh pressure level (e.g., 3000 kgf/cm$^2$).

The water-jet type cutting apparatus of the invention, as shown in FIG. 1, comprises the above described superhigh pressure control system, and an on-off valve 33 and a jet nozzle 34 disposed sequentially toward an end of the water discharge line 8 associated with the first and second boosters 1, 2, whereby a material to be cut 35 is cut by a jet of superhigh pressure water ejected from the jet nozzle 34.

The manner of operation of the above described superhigh pressure control system will be described with reference to FIGS. 2A, 2B, 2C, which description will concurrently serve as an explanation of the water-jet type cutting apparatus.

First, when starting the motor 36 which drives the first and second hydraulic pumps 11, 12, it is to be noted that where the discharge lines 15, 16 are connected to head chamber side ports of the oil hydraulic cylinders 6*a*, 6*b* through the first and second three-position directional control valves 9, 10, the load on the hydraulic pumps at rest and/or the inertia on the motor is so large that the load at the time of starting may be excessive. Therefore, at the time of motor starting, the control unit 31 causes the first and second three-position directional control valves 9, 10 to be positioned at the switching position for suction for a predetermined time (e.g., 7 seconds). Then, hydraulic oil discharged from the oil hydraulic pumps 11, 12 is supplied to the plunger-chamber side ports of the oil hydraulic cylinders 6*a*, 6*b* via lines 25, 26 and line 23, while hydraulic oil is discharged from the head-chamber side ports into the tank 32 to enable the pistons to return so that water is sucked into the plunger chambers 3*a*, 3*b* for water pressurizing. As a result, the loads on the hydraulic pumps 11, 12 are by far much smaller as compared with the case in which water is pressurized by forward piston strokes and thus the motor 36 will readily and positively be started without stall or halt.

Subsequently, the control unit 31 causes the first three-position directional control valve 9 to be positioned at the switching position for prepressing (center valve position) and the second three-position directional control valve 10 to be positioned at the switching position for pressing (left side position) respectively for a predetermined time (e.g., 1.5 seconds). Then, the motor 36 goes into steady operation without stopping to permit the hydraulic pumps 11, 12 to perform stable discharge of hydraulic oil. Whilst, the first booster 1 goes into a low-speed pressing stroke (prepressing stroke) under hydraulic oil supply via the first restriction 13 and the second booster 2 goes into a high-speed pressing stroke, and after the lapse of the above mentioned predetermined time, the pistons of the boosters respectively reach the positions shown in FIG. 2A. Thereafter, operation proceeds to the process of phase difference control of the boosters 1, 2 through alternate switching of the first and second three-position directional control valves 9, 10 which will be described hereinafter.

By virtue of this control, water pressure variations on the water discharge line 8 involved in the move to the phase difference control are substantially reduced so that a jet of water of stable superhigh pressure can be ejected from the jet nozzle 34.

Hitherto, in order to prevent any stall involved in starting the motor for hydraulic pumps, it has been general practice to provide a so-called feathering circuit such that any pressure which is applied on a discharge line because of a load involved at the time of starting is conducted to a swash plate control cylinder of the hydraulic pump for control such that the greater the pressure involved, the greater is the angular at which the swash plate is tilted toward the center valve position. However, the problem with the feathering circuit is that the circuit is complicated because of a large number of parts involved, and is expensive. According to the present invention, however, as described above, the control unit 31 causes the first and second three-position directional control valves 9, 10 to be positioned at respective switching positions for suction, and merely through this simple arrangement any possible motor stall can be positively prevented. This provides for good simplicity and cost reduction of the superhigh pressure control system.

Figure 2A:
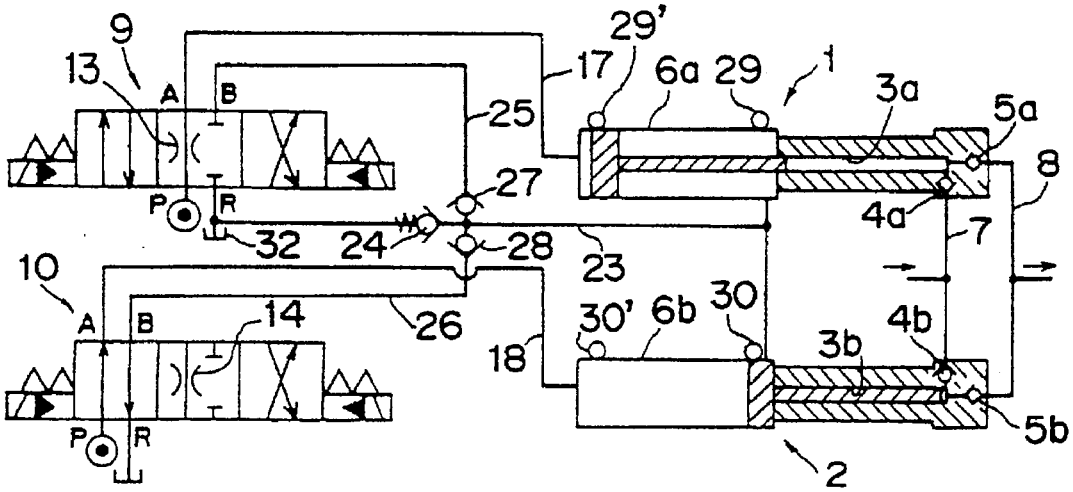
FIGS. 2A, 2B and 2C are diagrams showing an operating sequence with respect to the superhigh pressure control system.

In the phase difference control of the first and second boosters 1, 2 by the control unit 31, before the piston of the second booster 2 reaches the end of a pressing stroke shown in FIG. 2A, and at a point of time when the piston of the first booster 1 has passed the first return stroke sensor 29', the control unit 31, upon receipt of a passage detection signal from the sensor 29', switches the position of the first three-position directional control valve 9 from the right side position to the center valve position, whereby the first booster 1 which has been in a suction stroke goes into a low-speed pressing stroke under the action of the first restriction 13. Thus, as FIG. 2A shows, when the second booster 2 reaches the end the pressing stroke, the first booster 1 has proceeded 9% of one full pressing stroke in the case where the discharge pressure is 3000 kgf/cm$^2$, for example, so that it is ready to cause pressurized water of the above mentioned discharge pressure level to be discharged from the plunger chamber 3*a*. In other words, upon completion of discharge of superhigh pressure water from the second booster 2, the first booster 1 begins to discharge superhigh pressure water. Therefore, even where no accumulator is provided, possible variations in water pressure within the water discharge line 8 can be reduced and a pulsation-free superhigh pressure water is ejected from the jet nozzle 34 (see FIG. 1) at the end of the line to the material to be cut 35. The control unit 31, upon receipt of a detection signal from the second forward stroke sensor 30, switchingly shifts the second three-position directional control valve 10 from the left side position to the right side position, and the first three-position directional control valve 9 from the center valve position to the left side position. Thus, the second booster 2 goes into a suction stroke, while the first booster 1 goes into a high speed pressing stroke.

Figure 2B:
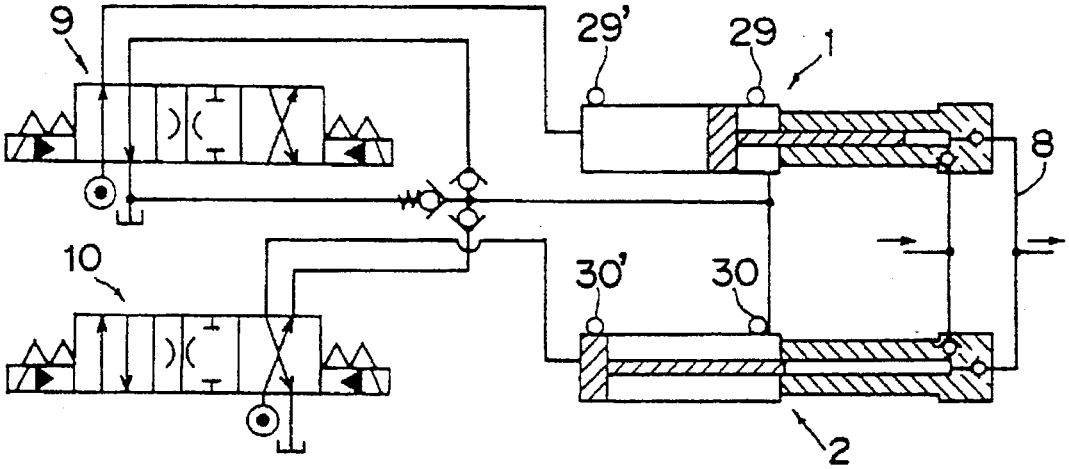

As FIG. 2B shows, during the process of a pressing stroke of the first booster 1, as the second booster 2 reaches the second return stroke sensor 30' at a position adjacent to the end of the suction stroke, the control unit 31, upon receipt of a passage detection signal from the sensor 30', switchingly shifts the second three-position directional control valve 10 from the right side position to the center valve position, whereupon the second booster 2 goes into a low-speed pressing stroke under the action of the second restriction 14.

Figure 2C:
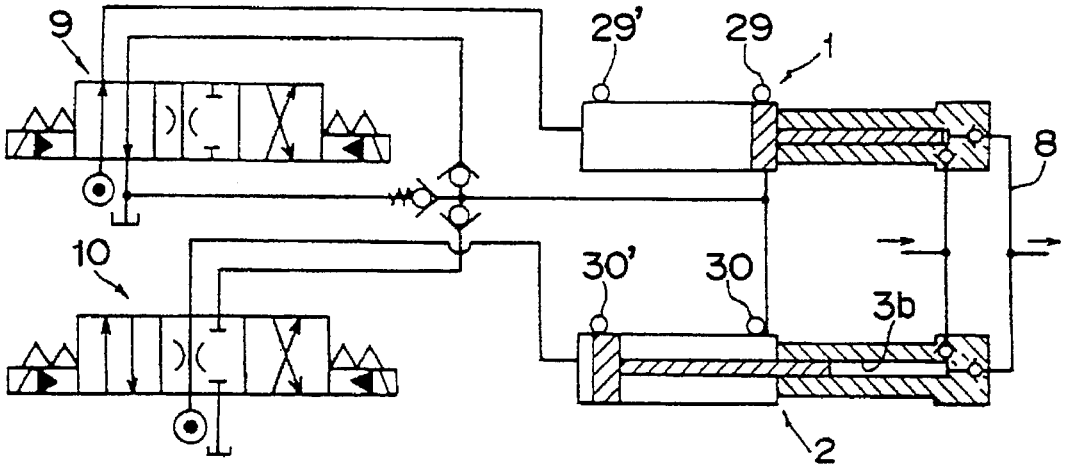

As FIG. 2C shows, when the first booster 1 reaches the end of the pressing stroke, the second booster 2 has travelled 9% of one full pressing stroke in the case of a discharge pressure of, for example, 3000 kgfcm$^2$ and is ready to cause a pressurized water of that discharge pressure to be discharged from the plunger chamber 3*b*. That is, at the end of discharge of superhigh pressure water from the first booster 1, the second booster 2 begins to discharge superhigh pressure water. Therefore, any water pressure variation in the water discharge line 8 is likewise reduced so that a superhigh pressure water involving less pulsation is ejected from the jet nozzle Then, the control unit 31, upon receipt of a detection signal from the first forward stroke sensor 29, switchingly shifts the first three-position directional control valve 9 from the left side position to the right side position, and the second three-position directional control valve 10 from the center valve position to the left side position. Thus, the first booster 1 goes into a suction stroke, while the second booster 2 goes into a high-speed pressing stroke.

Figure 4:
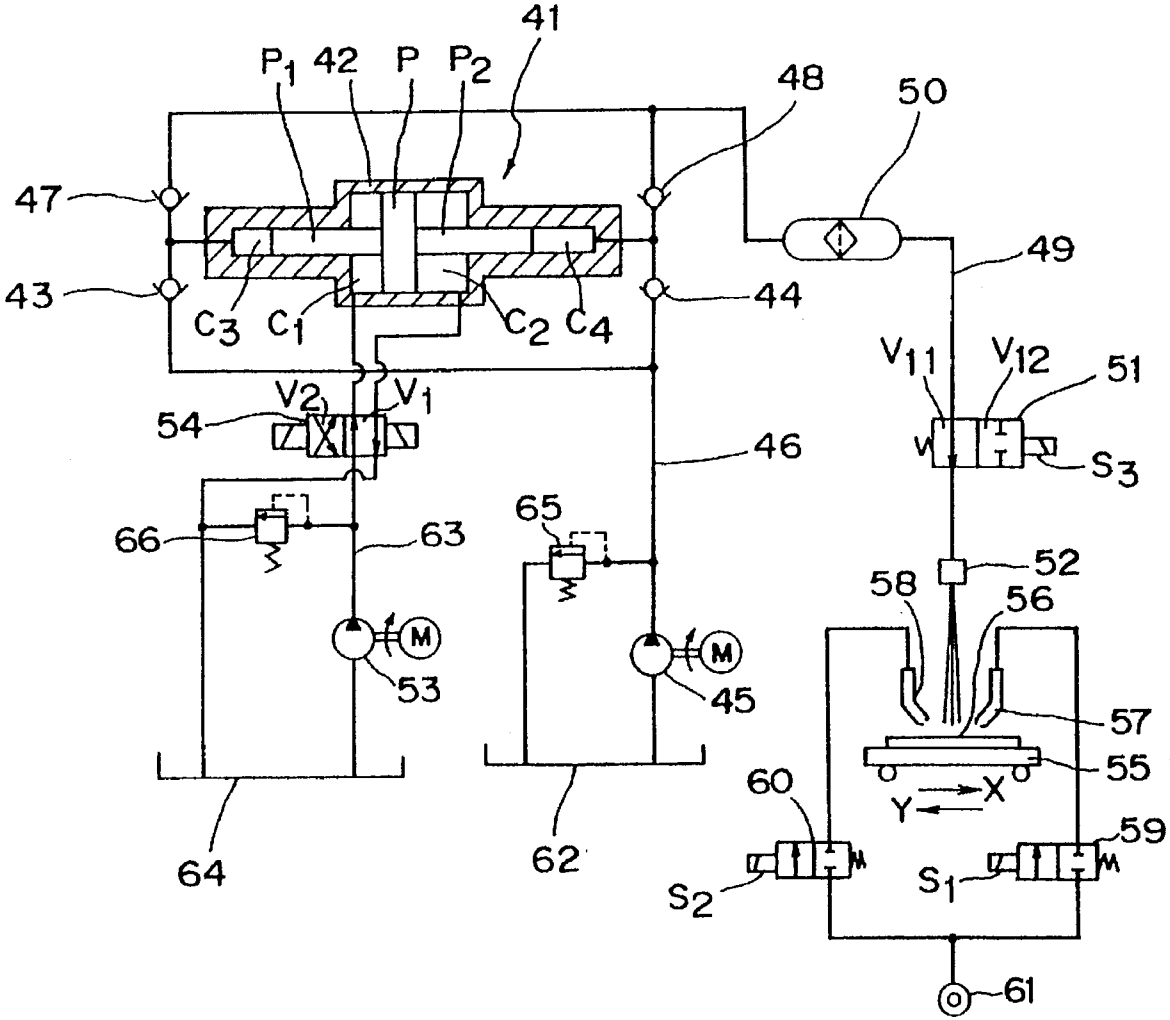
Fig. 4 Prior Art
FIG. 4 is a circuit diagram showing a prior art superhigh pressure control system.

In this way, without provision of a costly superhigh-pressure accumulator 50 (see FIG. 4) on the water discharge line 8, the invention provides for reduction in water pressure variations in superhigh pressure water, thus enabling pulsation-free superhigh pressure water to be ejected from the jet nozzle 34 to the material to be cut 35. Therefore, the invention also provides for improvement in the performance and service life of components, such as boosters 1, 2, employed in oil hydraulic and water hydraulic circuits, as well as for cost and size reduction in the manufacture of superhigh pressure control systems, and even water-jet type cutting apparatuses.

In the above described embodiment, there are provided first and second restrictions 13, 14 in P-A connection passageways in center valve positions or switching positions for prepressing with respect to the three-position directional control valves 9, 10. This provides an advantage that the flow rate of hydraulic oil supplied from the hydraulic pumps 11, 12 to the boosters 1, 2 can be adjusted and that the pressure of pressurized water in the plunger chambers 3*a*, 3*b* can be made to meet the predetermined discharge pressure requirement.

Further, the plunger-chamber side ports of oil hydraulic cylinders 6*a*, 6*b* of the boosters 1, 2 are connected to the tank 32 via the common return line 23 which is provided with a check valve 24 for back pressure setting, and this return line 23, at points which are nearer to respective hydraulic cylinders as viewed from the check valve 24 of the return line 23, is connected to ports B of respective three-position directional control valves 9, 10 via lines 25, 26 on which check valves 27, 28 are provided in reverse directions. Therefore, hydraulic oil discharged from the booster which is in the course of a pressing stroke is restrained from flowing toward the tank 32 without regard to respective switching positions of the three-position directional control valves 9, 10, with the result that the hydraulic oil flows into the booster which is in the course of a suction stroke, thereby to accelerate suction stroke or piston return stroke. This provides an advantage of cycle time reduction.

Further, in the above described embodiment, the hydraulic source consists of the first hydraulic pump 11 for the first booster 1, and the second hydraulic pump 12 for the second booster. As compared with the case where oil supply is made by a single common hydraulic pump, this provides an advantage that variations in the hydraulic pump load can be reduced, which means that variations in water pressure with respect to the superhigh pressure water discharged to the water discharge line 8 can be further reduced.

Needless to say, the water-jet type cutting apparatus employing the superhigh pressure control system of the above described embodiment has the above stated advantages of the superhigh pressure control system, in addition to the earlier described advantages of the apparatus itself.

In addition, for the purpose of starting the motor 36 for the hydraulic pumps 11, 12, the control unit 31 of the above described embodiment causes both the first and second three-position directional control valves 9, 10 to be positioned at respective switching positions for suction for a predetermined time, and subsequently causes the first three-position directional control valve 9 to be positioned at the prepressing position and the second three-position directional control valve 10 to be positioned at the pressing position, for a predetermined time. This is advantageous in that the load at the time of starting is reduced so that any possible motor stall may be prevented, with an added advantage that water pressure variations in the water discharge line 8 can be reduced at the time of shifting to the succeeding process of phase difference control.

In the foregoing embodiment, the hydraulic source consists of the first and second hydraulic pumps of the variable volume type exclusive for the respective boosters. Alternatively, the hydraulic source may consist of a single hydraulic pump of the variable volume type or a single hydraulic pump of fixed volume type.

It is possible to arrange that control means different from the control unit of the foregoing embodiment is employed to position the first and second directional control means at respective suction positions only at the time of motor starting. Even through such arrangement it is possible to prevent possible motor stall at the time of motor starting.

As is apparent from the above description, the superhigh pressure control system of the invention comprises first and second boosters connected in parallel to a water discharge line which are operative through reciprocal movement of hydraulic cylinders to pressurize water sucked into plunger chamber to superhigh pressure, first and second directional control means having three switching positions of pressing, prepressing and suction which are respectively disposed between respective hydraulic cylinders and a hydraulic source so as to enable reciprocation of the hydraulic cylinders of the boosters, first forward stroke and first return stroke sensors for detecting positions adjacent to the end of each pressing stroke and the end of each suction stroke which are disposed in the first booster, second forward stroke and second return stroke sensors similarly disposed in the second booster, and control means such that when the first booster is in its pressing stroke, the second directional control means is caused to be switched from the suction position to the prepressing position according to a signal from the second return stroke sensor; then on the basis of a detection signal from the first forward stroke sensor, the first directional control means is caused to be switched from the pressing position to the suction position and the second directional control means is caused to be switched from the prepressing position to the pressing position; and such that when the second booster is in its pressing stroke, the first directional control means is caused to be switched from the suction position to the prepressing position according to a signal from the first return stroke sensor; then on the basis of a detection signal from the second forward stroke sensor, the second directional control means is caused to be switched from the pressing position to the suction position and the first directional control means is caused to be switched from the prepressing position to the pressing position. Therefore, without provision of a costly superhigh pressure type accumulator on the water discharge line, water pressure variations of pressurized water can be reduced for enabling pulsation-free superhigh pressure water to be ejected. Further, it is possible to achieve improvement in the performance and service life of components, such as boosters, and reduction in the manufacturing cost and size of the system.

The superhigh pressure control system of the invention includes first and second restrictions provided in oil supply side passageways which serve as switching positions for prepressing for the first and second directional control means. Therefore, it is possible to adjust the pressure of superhigh pressure water discharged from the first and second boosters to the predetermined discharge pressure.

In the superhigh pressure control system of the invention, the hydraulic oil discharged from respective hydraulic cylinders of the first and second boosters during each pressing stroke is conducted to a tank via a common return line which is provided with a check valve for back pressure setting. Therefore, when one booster is in its pressing stroke, the suction stroke of the other booster can be accelerated, which can result in cycle time reduction.

Further, in the superhigh pressure control system of the invention, the hydraulic source consists of first and second hydraulic pumps exclusive for respective boosters. Therefore, load variations at the hydraulic pumps are reduced, with the result that pressure variations of the superhigh pressure water can be further reduced.

The water-jet type cutting apparatus of the invention comprises the above described superhigh pressure control system, and an on-off valve and a jet nozzle disposed sequentially on the water discharge line. Therefore, the apparatus permits satisfactory cutting operation by a stable and pulsation-free jet of superhigh pressure water, and offers added advantages of increased cost economy, size reduction, and improved performance and service life.

The superhigh pressure control system of the invention includes first and second boosters and first and second directional control means, wherein hydraulic pumps are driven by a motor and, at the time of motor starting, control means cause the first and second directional control means to be positioned at respective switching positions for suction strokes for a predetermined time. By virtue of this arrangement, the superhigh pressure control system can prevent motor stall troubles by reducing the load at the time of motor starting, with simple and inexpensive construction.

INDUSTRIAL APPLICABILITY

The superhigh pressure control system of the invention is employed in water-jet type cutting apparatuses and the like for generating superhigh pressure water with less pressure variation.

What is claimed is:

1. A superhigh pressure control system comprising:

a first booster and a second booster which are operative through reciprocating motions of oil hydraulic cylinders to pressurize water sucker into wet or pressurizing plunger chambers and discharge pressurized water to a water discharge line;

first directional control means and second directional control means which are respectively disposed between respective oil hydraulic cylinders of the first and second boosters and oil hydraulic sources so as to enable reciprocation of the oil hydraulic cylinders, the first and second directional control means having three switching positions, which are pressing, prepressing and suction positions;

a first forward stroke sensor for detecting a position adjacent to the end of each pressing stroke and a first return stroke sensor for detecting a position adjacent to the end of each suction stroke which are disposed in the first booster;

a second forward stroke sensor for detecting a position adjacent to the end of each pressing stroke and a second return stroke sensor for detecting a position adjacent to the end of each suction stroke which are disposed in the second booster; and control means which is operative, during each pressing stroke of the first booster, to switch the second directional control means from the suction position to the prepressing position in response to a detection signal from the second return stroke sensor, and then to switch the first directional control means from the pressing position to the suction position and the second directional control means from the prepressing position to the pressing position in response to a detection signal from the first forward stroke sensor, and which is operative, during each pressing stroke of the second booster, to switch the first directional control means from the suction position to the prepressing position in response to a detection signal from the first return stroke sensor, and then to switch the second directional control means from the pressing position to the suction position and the first directional control means from the prepressing position to the pressing position in response to a detection signal from the second forward stroke sensor.

2. A superhigh pressure control system as claimed in claim 1, wherein a first restriction and a second restriction are provided respectively in oil-supply side passages at switching positions for prepressing for the first directional control means and second directional control means.

3. A superhigh pressure control system as claimed in claim 1, wherein hydraulic oil discharged during the pressing stroke of each of the hydraulic cylinders of the first and second boosters is discharged into a tank via a common return line, the common return line being provided with a check valve for setting back pressure.

4. A superhigh pressure control system as claimed in any one of claims 1 to 3, wherein the hydraulic sources consist of a first oil hydraulic pump provided for the first booster and a second oil hydraulic pump provided for the second booster.

5. A water-jet type cutting apparatus comprising the superhigh pressure control system defined in claim 1, a jet nozzle disposed at an end of the water discharge line, and an on-off valve disposed between the jet nozzle and the superhigh pressure control system.

6. A super-high pressure control system comprising:

a first booster and a second booster which are operative through reciprocating motions of oil hydraulic cylinders to pressurize water sucked into water-pressurizing plunger chambers and discharge pressurized water to a water discharge line;

first directional control means and second directional control means which are respectively disposed between respective oil hydraulic cylinders of the first and second boosters and oil hydraulic pumps actuated by a motor so as to enable reciprocation of the oil hydraulic cylinders, the first and second directional control means having three switching positions, which are a pressing position for pressing water in each plunger chamber, a prepressing position for prepressing water in each plunger chamber and a suction position for causing each plunger chamber to suck water; and control means for positioning both the first and second directional control means at switching positions for suction for a predetermined time when the motor is actuated.

* * * * *